United States Patent [19]

Lappa

[11] 4,043,556

[45] Aug. 23, 1977

[54] WHEEL ROLLING GAME

[76] Inventor: Cleto L. Lappa, 541 Torwood Lane, Pittsburgh, Pa. 15236

[21] Appl. No.: 668,847

[22] Filed: Mar. 22, 1976

[51] Int. Cl.[2] ..... A63F 9/14

[52] U.S. Cl. ..... 273/86 R; 46/206

[58] Field of Search ..... 273/86 R, 86 C; 46/68, 46/206, 209

[56] References Cited

U.S. PATENT DOCUMENTS

| | | | |
|---|---|---|---|
| 1,952,547 | 3/1934 | Graves | 46/68 X |
| 3,701,216 | 10/1972 | Smith et al. | 46/209 |
| 3,733,742 | 5/1973 | Terzian | 46/206 |
| 3,815,911 | 6/1974 | Cooper | 273/86 C |

*Primary Examiner*—Anton O. Oechsle

*Attorney, Agent, or Firm*—William J. Ruano

[57] ABSTRACT

A game comprising a base having two separately and detachably mounted wheels on the sides thereof which may be separately spun by competing players and run off in the same direction. The player making the wheel go farthest or reach the "finish" line first is the winner. The spinning is done by handles with oppositely twisted flat rods which fit into a central correspondingly shaped slot in each wheel.

1 Claim, 9 Drawing Figures

WHEEL ROLLING GAME

This invention relates to a game or toy. More specifically, it relates to a game involving spinning of separate wheels by opposing players, the winner being determined by either the wheel going the greatest distance or that reaching a "finish" line first.

An outstanding disadvantage of game or toys of this general character is that they are somewhat complicated and expensive and not readily operable by very young children.

Still another disadvantage is that commonly used toys tend to break easily and have relatively short life.

An object of the present invention is to overcome the abovenamed disadvantages by providing a novel game or toy which is simple in construction and operation, involving a minimum number of simple parts and which is easy operably by small children.

Another object of the present invention is to provide a game involving spinning and rolling separate wheels in the same direction, which game provides a high degree of amusement to small children by simple operations.

Other objects and advantages will become more apparent from a study of the following description taken with the accompanying drawings wherein.

Referring more particularly to FIGS. 1 to 4 inclusive, numeral 1 denotes a base of plastic, metal, wood or any other suitable material having an arrow marker 1*a* to denote the direction of rolling movement of the wheels to be described. Numerals 2 and 3 denoting integral upstanding side portions having slots 2*a* and 3*a*, respectively, therein for mounting separate wheels 6 and 5, respectively each having a central slot 6*a* and 5*a*, respectively, into which is snugly fitted, helically twisted, flat spinning rods 7*a* and 8*a*, having integral handles 7 and 8, respectively.

Figure 7:
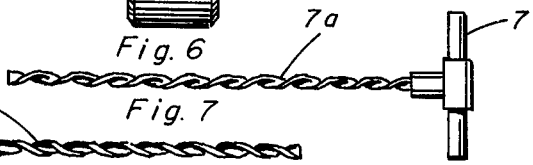
FIG. 7 shows an elevational view of one of the handles and spinning rods; and, FIG. 8 shows an elevational view of the other handle and spinning rod.
Figure 8:
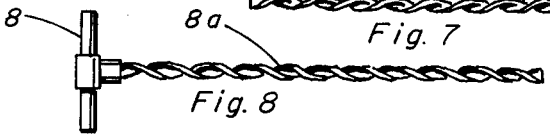

It will be particularly noted, especially in FIGS. 7 and 8, the respective rods 7*a* and 8*a* are twisted in opposite directions so that when the handles are pulled from the respective slots, the two wheels 5 and 6 will roll in the in the same direction as indicated by arrow 1*a*.

Figure 1:
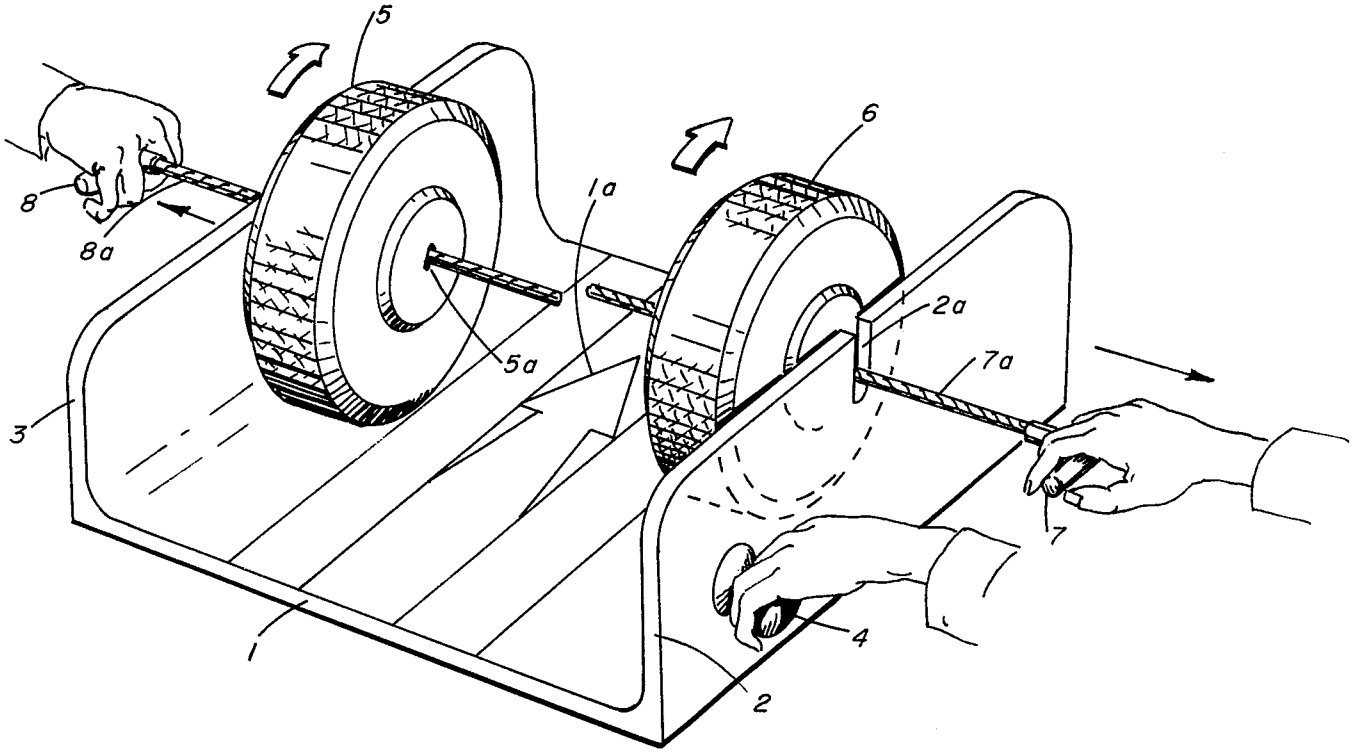
FIG. 1 is a top perspective view of a game or toy embodying the principles of the present invention.
Figure 2A:
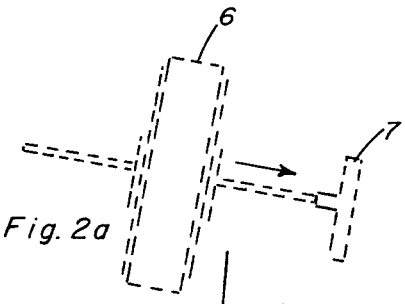
FIG. 2 is a front view thereof.
Figure 2:
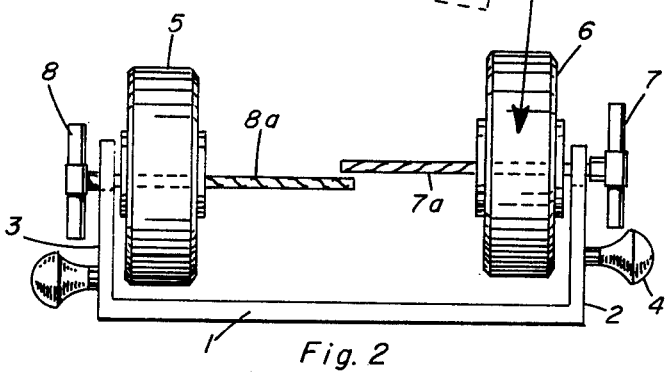
Figure 3:
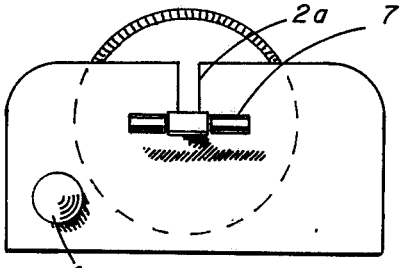
FIG. 3 is a side view thereof viewed from the right of FIG. 1 and FIG. 2a in dotted outline shows the initial position in mounting a wheel and handle.
Figure 4:
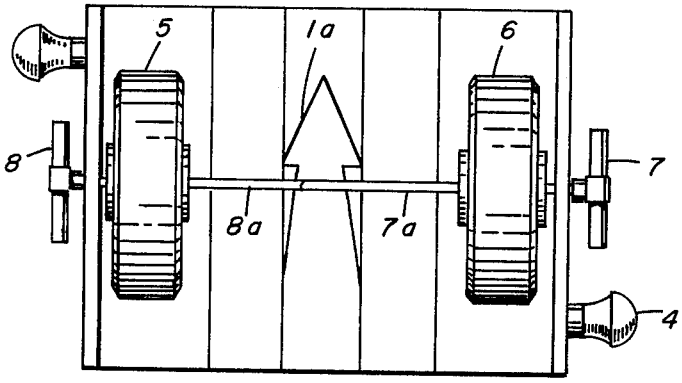
FIG. 4 is a top view thereof.
Figure 5:
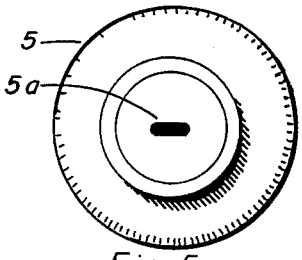
FIG. 5 is an elevational view of one of the wheels.
Figure 6:
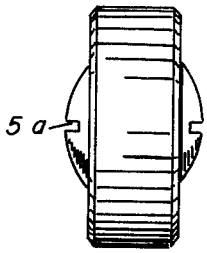
FIG. 6 is a side view of the wheel of FIG. 5.

In operation, each of the two players inserts one of the twisted rods into the slot of his wheel by a turning action of the handle until the rod is forced inwardly of the sidewall to the position shown in FIGS. 2 and 4 wherein the rods 7*a* and 8*a* are very close to each other. Then, after a signal is given, each of the two players pulls his handle forcefully, as shown in FIG. 1, so as to spin his wheel in place until the rod is completely withdrawn from the wheel slot, at which time the wheel will take off and roll at a relatively high speed in the direction of the arrow 1*a*, The winner will be determined either by the wheel going farthest, or by the wheel passing a predetermined point, such as a "finish" line, the earliest.

Thus it will be seen that I have provided a highly efficient, relatively simple and inexpensive game having very long life and affording a great deal of pleasure and amusement to children of all ages as well as adults.

While I have illustrated and described a single specific embodiment of my invention, it will be understood that this is by way of illustration only and that various changes and modifications may be contemplated in my invention and within the scope of the following claims.

I claim:

1. A game comprising a base having a pair of upstanding sidewalls, each having a slot on the top thereof, a pair of separate wheels each having a central slot, a pair of handles, each having an integral, helically twisted rod extending at right angles thereof, snugly fitting into one of said slots of each wheel, said rods being helically twisted in opposite directions, said handles extending outwardly of said sidewalls while said rods extend beyond the inward surfaces of said wheels while resting on said slots in a manner to hold the wheels slightly above the surface of said base, whereby as separate players pull the respective handles outwardly of said sidewalls, said wheels will spin by virtue of withdrawal of said rods so that upon complete withdrawal, said wheels will independently roll in the same direction without lateral movement.

* * * * *